US008746482B2

(12) United States Patent
Ben Afeef

(10) Patent No.: US 8,746,482 B2
(45) Date of Patent: Jun. 10, 2014

(54) STORAGE TANK FLOATING ROOF SUMP WITH EMERGENCY OVERFLOW

(71) Applicant: Saudi Arabian Oil Company, Dhahran (SA)

(72) Inventor: Mohammed A. Ben Afeef, Jeddah (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 13/644,870

(22) Filed: Oct. 4, 2012

(65) Prior Publication Data

US 2013/0153573 A1 Jun. 20, 2013

Related U.S. Application Data

(63) Continuation of application No. 12/729,784, filed on Mar. 23, 2010, now Pat. No. 8,302,797.

(51) Int. Cl.
*B65D 88/38* (2006.01)
*B65D 88/34* (2006.01)

(52) U.S. Cl.
CPC ..... *B65D 88/38* (2013.01); *B65D 88/34* (2013.01)
USPC ..... 220/219; 220/567.2

(58) Field of Classification Search
CPC ..... B65D 88/38; B65D 88/34
USPC ..... 220/219, 216, 567.2, 200, 567.1
IPC ..... B65D 88/38, 88/34, 88/00
See application file for complete search history.

(56) References Cited

U.S. PATENT DOCUMENTS

| | | | |
|---|---|---|---|
| 1,559,016 | A | 10/1925 | Stovall |
| 1,574,013 | A | 2/1926 | Wiggins |
| 2,563,017 | A | 8/1951 | Field |
| 2,664,220 | A | 12/1953 | Cord et al. |
| 2,846,109 | A | 8/1958 | Larsen |
| 3,823,842 | A | 7/1974 | Chang |
| 3,861,552 | A | 1/1975 | Adams |
| 3,883,032 | A | 5/1975 | Fisher |
| 3,944,113 | A | 3/1976 | Heisterberg |
| 4,134,515 | A | 1/1979 | Hills et al. |
| 4,202,366 | A | 5/1980 | Kamvachirapitag |
| 4,248,357 | A | 2/1981 | Stafford |

(Continued)

FOREIGN PATENT DOCUMENTS

JP 5077883 3/1993

OTHER PUBLICATIONS

International Search Report and Written Opinion, May 20, 2011.

*Primary Examiner* — Robert J Hicks
(74) *Attorney, Agent, or Firm* — Abelman, Frayne & Schwab

(57) ABSTRACT

A floating roof and emergency overflow drainage system for water accumulated on the floating roof covering liquid in a storage tank, including:

Figure 1:
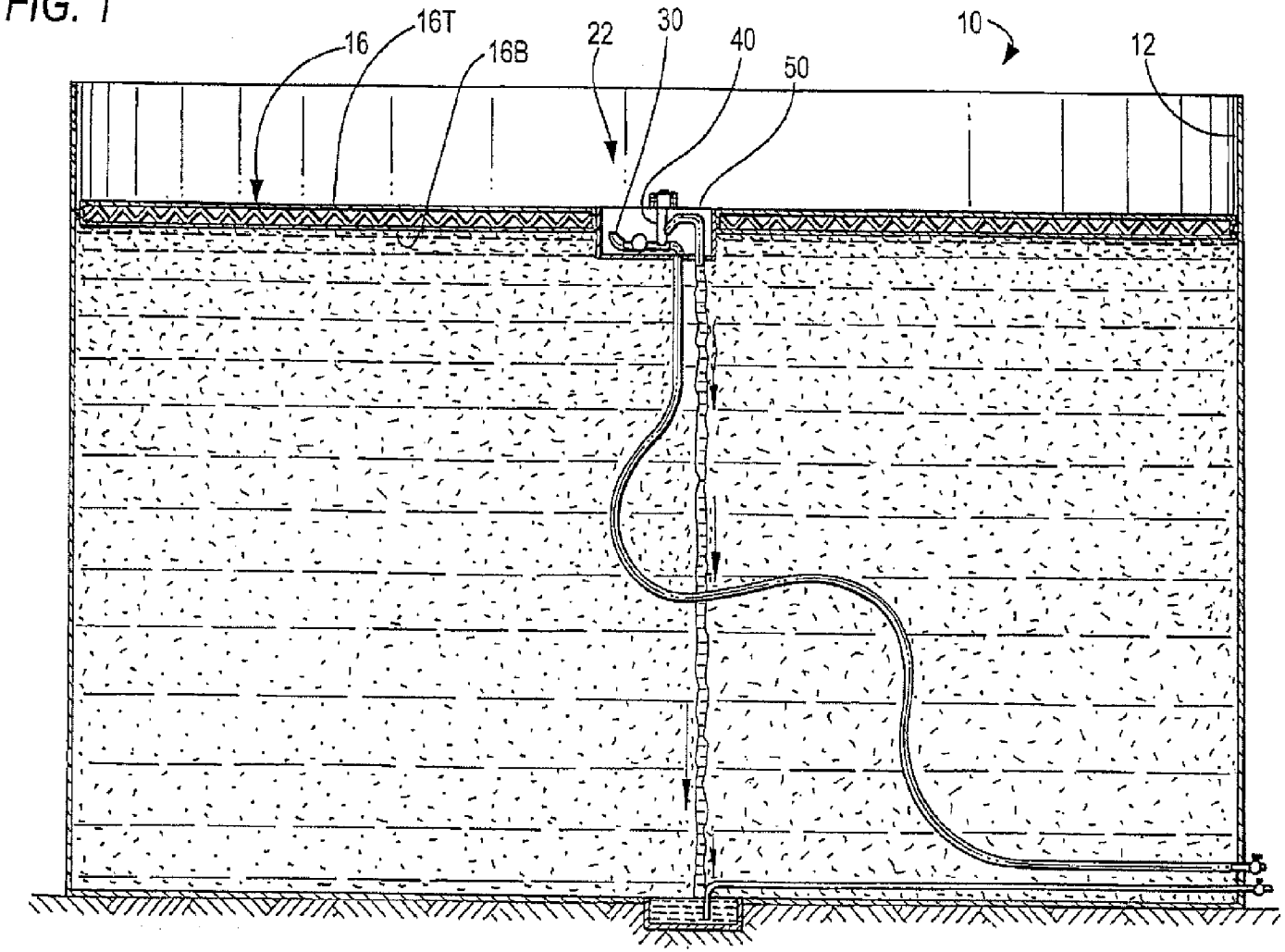

a. a water collection sump formed as a downward extending recess in the top surface of the roof, b. a first drainage duct having an inlet within the water collection sump, an outlet for draining water below the sump, and an intermediate portion, c. a second drainage duct having an inlet above the top surface of the roof, an intermediate portion, and an outlet in fluid communication with the intermediate portion of the first duct in the sump, and d. an emergency overflow duct including:

(1) an inlet in fluid communication with the second duct, and (2) a distal portion extending downwardly and terminating in an outlet below the sump and in the stored liquid.

20 Claims, 2 Drawing Sheets

(56) References Cited

U.S. PATENT DOCUMENTS

| | | | |
|---|---|---|---|
| 4,470,437 | A | 9/1984 | Rabinovich |
| 4,790,446 | A | 12/1988 | Thiltgen |
| 5,758,792 | A | 6/1998 | Jolly |
| D452,899 | S | 1/2002 | Salisbury |
| 6,338,169 | B1 | 1/2002 | DeGarie |
| D485,889 | S | 1/2004 | DuBois |
| 2007/0272692 | A1 | 11/2007 | Hiner |
| 2008/0155918 | A1 | 7/2008 | Ben Afeef |

STORAGE TANK FLOATING ROOF SUMP WITH EMERGENCY OVERFLOW

RELATED PATENT CASE

This continuation application claims priority under 35 U.S.C. & 119, 120 and/or 365 based upon applicant's parent application Ser. No. 12/729,784, filing date Mar. 23, 2010, now issued U.S. Pat. No. 8,302,797.

I. FIELD OF THE INVENTION

The present invention relates to a drainage device for use on a floating roof on a storage tank for liquid products.

II. BACKGROUND OF THE INVENTION

Storage tanks for oil and other liquid hydrocarbon products are typically provided with a floating roof. The floating roof moves vertically on the surface of the liquid product to prevent the escape of harmful vapors. A typical floating roof for covering a liquid product in a storage tank includes a deck whose peripheral side edges substantially conform to the horizontal cross-sectional shape of the storage tank. The roof has a vertical thickness and is provided with one or more seals extending between the outer periphery of the floating roof and the inner wall of the tank. The roof floats on top of the stored liquid product and rises and falls as the amount of the liquid product increases and decreases. It is known to provide a drain pipe extending vertically through the top surface of deck to drain water accumulated atop the roof and to provide a passage or conduit for the drained water from the surface of the roof to pass through the stored liquid and accumulate at the bottom of the tank where it is eventually drained from the tank.

During seasonal or other periods of heavy rains the amount of water that accumulates over the area of the storage tank roof or cover can be substantially greater than that which can be removed by the centrally positioned drain. The water will therefore rise and can inundate the drain sealing mechanism. Also, the presence of debris carried by the accumulating water can interfere with proper operation of complex roof drain apparatus known to the prior art.

A further problem can occur when rainwater accumulates on the roof and its effective weight increases to a point where it can overcome the buoyancy of the roof, eventually forcing it into the liquid in the tank. It is therefore important to provide an effective and reliable means for draining water from the roof so that it does not exceed a pre-determined depth and weight.

Various approaches have been proposed for draining water from storage tank floating roofs. For example, U.S. Pat. No. 2,560,586 to Michaels discloses a floating roof drain which drains water collected over a valve of the floating roof which closes and opens a drain passage. The weight of the water collected over the valve pushes down a cover against the buoyancy force of a float connected to the valve to allow the water collected to flow from the roof. The valve is again closed when the depth of the water on the roof decreases until it is no longer sufficient to hold the valve open against the buoyancy force of the float.

U.S. Pat. No. 2,913,138 to Swick describes floating covers for tanks in which a drainage device is located at a low point of the roof structure in a deck. The drainage device comprises a cylindrical sump, a sump bottom formed with a shallow depression which constitutes a downward flow passage, a cylindrical neck extending from the bottom of the sump and an annular float member loosely surrounding the sidewall of the neck. A mercury seal is provided on the bottom, and the float member rests on the bottom of the pool of mercury. Accumulated water in the sump buoys up the float member to interrupt the mercury seal and thereby provide a conduit for water to drain across the surface of the pool.

U.S. Pat. No. 3,883,032 to Fisher discloses an automatic drain valve for a floating roof which includes an orifice and a larger disk located under the orifice. A float attached to the disk allows the valve to be biased closed and water gathered on top of the roof will open the valve which permits the water to drain through the roof into the tank beneath to join the body of liquid product with the tank.

Japanese Patent No. JP5077883 to Kunio discloses an emergency drain device for a floating roof in which a drain pipe runs through a deck up to stored liquid in a tank and a float, which floats on accumulated liquid on the deck and is on an upper end of the drain pipe, prevents vapor from flowing out of the drain pipe. A weight-attached guide member makes the float return to the upper end of the drain pipe.

Still other prior art patents disclosing aspects of floating roofs and drainage systems are U.S. Pat. Nos. 2,563,017; 2,664,220; 4,134,515; 4,202,366; 3,944,113 and US 2007/0272692; however, these prior art patents do not disclose a system the same as or equivalent to the present emergency drainage system described below.

III. OBJECTS OF THE PRESENT INVENTION

The above discussed prior art systems for draining water from floating roofs do not overcome the problems of reliability, performance under extreme conditions and secure sealing of the drain opening associated with floating roofs. Unfavorable weather conditions, such as high winds and a significant accumulation of rainwater, may cause the roof to sink or become damaged. Another problem to be considered is evaporation losses of liquid product stored in the tank.

It is therefore an object of the present invention to provide an apparatus for effectively and reliably draining accumulated rain water from a floating roof on a liquid product tank by a self-opening emergency overflow apparatus to provide adequate drainage if the primary drainage system fails.

A further object is to prevent weight overload on the floating roof which could damage, break or sink its by providing emergency drainage if and when the primary drainage system fails.

It is an additional object to provide an emergency overflow drainage system that is combined with or integrated with the primary drainage system.

An additional object is to provide an emergency drainage system which is automatically activated if the check valve in the primary drainage system fails or if there is any other backup of water.

Another object of the invention is to provide an apparatus for draining accumulated rain water from the top of a roof on a liquid product tank while also reduces product evaporation losses to the atmosphere.

A further object of the invention is to provide an automatic roof drain apparatus that is of simple and rugged construction and inexpensive to manufacture and install.

IV. SUMMARY OF THE INVENTION

The above objects, as well as other advantages described herein, are achieved by a new emergency drainage system which is automatically operative if the water level reaches the maximum allowable level at the roof center or wherever such maximum allowable level is measured. In the preferred embodiment illustrated herein, the new emergency drainage system has an inlet at a location intermediate the inlet of the primary drainage duct in the sump and the outlet of the primary drainage duct below the sump. In the preferred embodiment shown, the emergency overflow duct extends from its inlet at an upward incline and then extends transversely at an elevation above the highest level of the stored liquid product, which is thus above the bottom level of the floating roof, and below the maximum allowable level of accumulated water atop the floating roof. This emergency drainage duct then extends downward in order to discharge the overflow water into the stored product in the storage tank or to a further drainage duct.

This invention is further defined as follows.

Embodiment 1. A floating roof and emergency overflow drainage system for water accumulated on a floating roof which has a bottom surface adapted to cover and float atop a liquid in a storage tank, said tank adapted to contain said accumulated water up to a predetermined maximum allowable level L1 above the roof's top surface, where said floating roof further includes an annular seal adapted to engage both the outer circumferential edge of the roof and the adjacent inner wall of said tank, said seal having a bottom surface adapted to define the highest level of said liquid relative to said floating roof, said system comprising:

a. a water collection sump formed as a downward extending recess in said top surface of said roof and adapted to receive water accumulated atop said roof, b. a first drainage duct having an inlet within said water collection sump at an elevation L5 below said top surface of said roof, an outlet for draining water at an elevation L7 below said sump, and an intermediate portion extending transversely between said inlet and said outlet, c. a second drainage duct having an inlet above said top surface of said roof, an intermediate portion extending downwardly from said inlet, and an outlet in fluid communication with said intermediate portion of said first duct in said sump, and d. an emergency overflow duct including:

(1) an inlet in fluid communication with said second duct, (2) a proximal portion extending upwardly from said inlet, (3) a medial portion extending transversely from said proximal portion at an elevation L3 higher than said bottom surface of said seal, and (4) a distal portion extending downward from said medial portion and terminating in an outlet below said sump.

Embodiment 2. A floating roof and emergency overflow drainage system according to Claim 1 where said emergency overflow duct inlet is in fluid communication with said intermediate portion of said second drainage duct.

Embodiment 3. A floating roof and emergency overflow drainage system according to Claim 2 where said proximal portion of said emergency overflow duct extends from said inlet thereof at an upward inclined angle to said medial portion thereof.

Embodiment 4. A floating roof and emergency overflow drainage system according to Claim 3 where said medial portion of said emergency overflow duct extends generally horizontally between said proximal portion and said distal portion.

Embodiment 5. A floating roof and emergency overflow drainage system according to Claim 1 where said first drainage duct further comprises a check valve in said intermediate portion thereof allowing fluid flow only in the direction from said inlet to said outlet thereof.

Embodiment 6. A floating roof and emergency overflow drainage system according to Claim 1 wherein said second duct and said proximal portion of said emergency overflow duct define generally an upright Y shape having at least one upwardly inclined arm, and with said proximal portion of said emergency overflow duct being said at least one upward inclined arm of said Y shape.

Embodiment 7. A floating roof and emergency overflow drainage system according to Claim 1 wherein the said inlet of said second duct further comprises a floatable cover that has a lower position where it closes said inlet of said second duct and an upper position where it opens said inlet, said cover remaining in its lower position until accumulated water atop said roof causes said cover to float upward to said open position.

Embodiment 8. A floating roof and emergency overflow drainage system according to Claim 7 wherein said cover comprises a central part and at least one downward extending buoyant float element, said cover when in its lower position having said central part sealed against said inlet of said second duct.

Embodiment 9. A floating roof and emergency overflow drainage system according to Claim 8 where said float element has a generally round cylindrical shape generally coaxial with said second duct.

Embodiment 10. A floating roof and emergency overflow drainage system according to Claim 8 where said cover comprises two spaced apart buoyant float elements extending downward from said central part.

Embodiment 11. A floating roof and emergency overflow drainage system according to Claim 1 wherein said overflow outlet of said emergency overflow duct discharges into said stored product below said sump.

Embodiment 12. A floating roof and emergency overflow drainage system according to Claim 1 where said first duct outlet is external of said tank.

Embodiment 13. A method of providing emergency overflow drainage for water accumulated on a floating roof which has a bottom surface adapted to cover and float on a liquid in a storage tank, said tank adapted to contain said accumulated water up to a predetermined maximum allowable level on the roof's top surface, where said floating roof includes an annular seal adapted to engage both the outer circumferential edge of the roof and the adjacent inner surface of the wall of said tank, said seal having a bottom surface adapted to define the highest level of said liquid relative to said floating roof, said method comprising:

a. providing a water collection sump formed as a downward extending recess in said top surface of said roof and adapted to receive water accumulated atop said roof, b. providing a first drainage duct having an inlet within said water collection sump at an elevation L5 below said top surface 16 said roof, an outlet for draining water at an elevation L7 below said sump, and an intermediate portion extending transversely between said inlet and said outlet, c. providing a second drainage duct having an inlet above said top surface of said roof, an intermediate portion extending downwardly from said inlet, and an outlet in fluid communication with said intermediate portion of said first duct in said sump, and d. providing an emergency overflow duct including:

(1) an inlet in fluid communication with said second duct, (2) a proximal portion extending upwardly from said inlet, (3) a medial portion extending transversely from said proximal portion at an elevation L3 higher than said bottom surface of said seal, and (4) a distal portion extending downward from said medial portion and terminating in an outlet below said sump.

Embodiment 14. A storage tank with a roof adapted to float atop a liquid stored in said tank and an emergency overflow drainage system for water accumulated on said floating roof, said tank adapted to contain said accumulated water up to a predetermined maximum allowable level above the roof's top surface, where said floating roof further includes an annular seal adapted to engage both the outer circumferential edge of the roof and the adjacent inner wall of said tank, said seal having a bottom surface adapted to define the highest level of said liquid relative to said floating roof, said system comprising:

a. a water collection sump formed as a downward extending recess in said top surface of said roof and adapted to receive water accumulated atop said roof, b. a first drainage duct having an inlet within said water collection sump at an elevation below said top surface of said roof, an outlet for draining water at an elevation below said sump, and an intermediate portion extending transversely between said inlet and said outlet, c. a second drainage duct having an inlet above said top surface of said roof, an intermediate portion extending downwardly from said inlet, and an outlet in fluid communication with said intermediate portion of said first duct in said sump, and d. an emergency overflow duct including:

(1) an inlet in fluid communication with said second duct, (2) a proximal portion extending upwardly from said inlet, (3) a medial portion extending transversely from said inlet at an elevation higher than said bottom surface of said seal, and (4) a distal portion extending downward from said medial portion and terminating in an outlet below said sump.

Embodiment 15. A floating roof and emergency overflow drainage system according to Claim 14 where said emergency overflow duct inlet is in fluid communication with said intermediate portion of said second drainage duct.

Embodiment 16. A floating roof and emergency overflow drainage system according to Claim 13 where said proximal portion of said emergency overflow duct extends from said inlet thereof at an upward inclined angle to said medial portion thereof.

Embodiment 17. A floating roof and emergency overflow drainage system according to Claim 14 where said medial portion of said emergency overflow duct extends generally horizontally between said proximal portion and said distal portion.

Embodiment 18. A floating roof and emergency overflow drainage system according to Claim 14 where said first drainage duct further comprises a check valve in said intermediate portion thereof allowing flow only in the direction of said inlet to said outlet thereof.

Embodiment 19. A floating roof and emergency overflow drainage system according to Claim 14 wherein said second duct and said proximal portion of said emergency overflow duct define generally an upright Y shape having at least one upwardly inclined arm, and with said proximal portion of said emergency overflow duct being said at least one upward inclined arm of said Y shape.

Embodiment 20. A floating roof and emergency overflow drainage system according to Claim 14 wherein the said inlet of said second duct further comprises a floatable cover that has a lower position where it closes said inlet of said second duct and an upper position where it opens said inlet, said cover remaining in its lower position until accumulated water atop said roof causes said cover to float upward to said open position.

Embodiment 21. A floating roof and emergency overflow drainage system according to Claim 14 wherein said cover comprises a central part and at least one downward extending buoyant float element, said cover when in its lower position having said central part sealed against said inlet of said second duct.

V. BRIEF DESCRIPTION OF THE DRAWINGS

Figure 2:
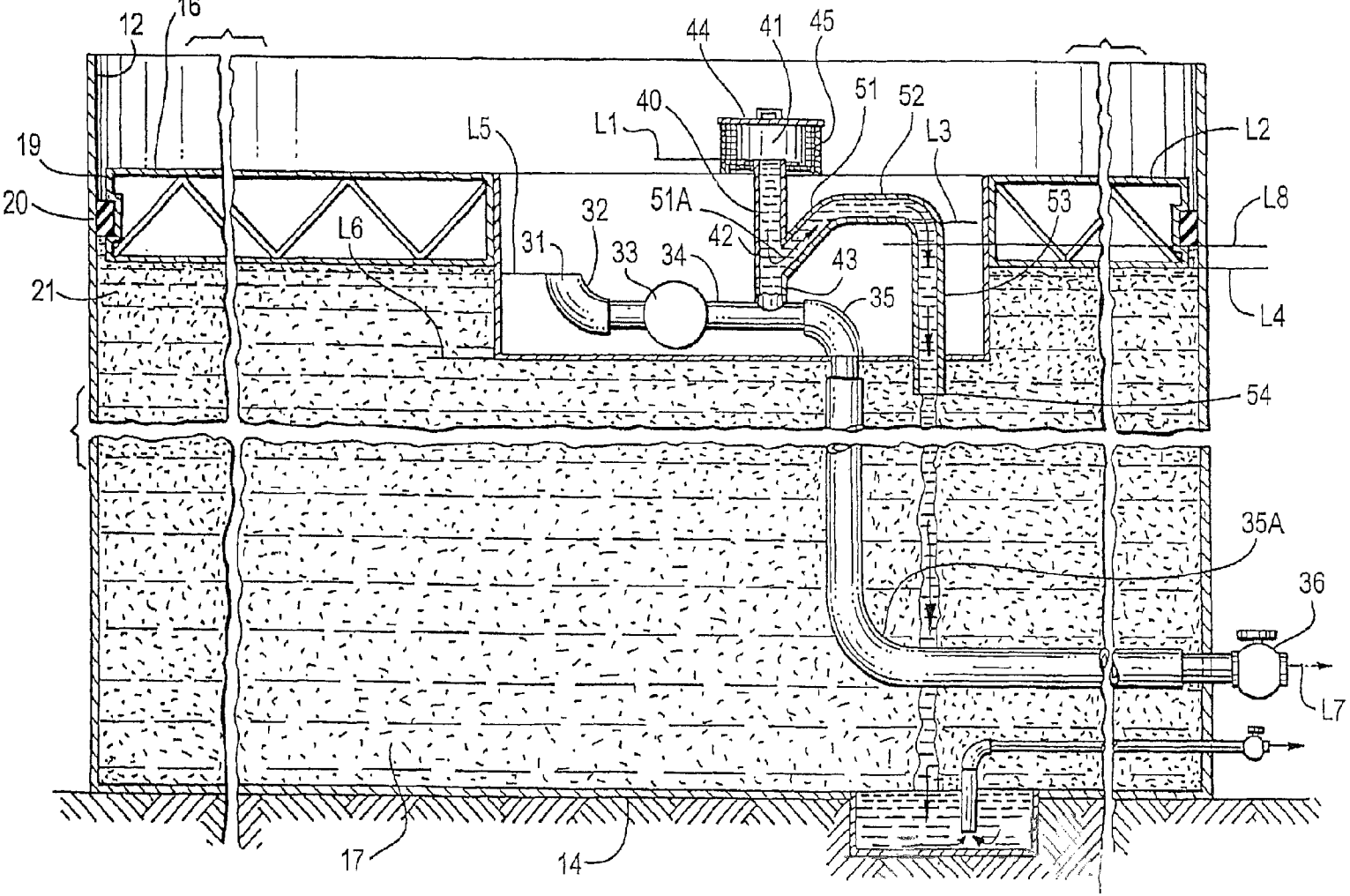

The invention will be further described in detail in conjunction with the accompanying drawings in which:

FIG. 1 is a side elevation view shown schematically of a liquid product storage tank with a floating roof with an overflow water drainage system comprising primary (first and second) drainage ducts and an emergency overflow drainage duct, and FIG. 2 is an enlarged fragmentary side elevation view of the drainage ducts in the floating roof of FIG. 1

VI. DETAILED DESCRIPTION OF THE PREFERRED EMBODIMENTS

To facilitate an understanding of the invention, the same reference numerals have been used, when appropriate, to designate the same or similar elements that are common to the figures. Unless stated otherwise, the features shown and described in the figures are not drawn to scale, but are shown for illustrative purposes only.

FIG. 1 shows storage tank 10 formed of cylindrical side walls 12, having inner surfaces, bottom 14 and floating roof 16, having top surface 16T and bottom surface 16B, intended primarily for containing a liquid petroleum product 17 that varies in quantity within tank 10 and on which roof 16 floats. Between the roof's peripheral edges 19 and the storage tank side walls 12 is a seal element 20 that seals the circumferential gap from upward flowing fumes 21 between said side walls 12 and peripheral edge 19, while allowing roof 16 to move upward and downward as it floats on liquid product 17. Shown schematically in roof 16 is sump 22.

As discussed earlier, the concern with a storage tank as shown is that if the quantity and weight of water (as rain water) accumulates to an excessive level, there can be damage to the roof, leakage of fumes upward, sinking of the roof into the liquid petroleum product, and/or or massive flow of rain water into the liquid petroleum.

To solve the excessive accumulated water problem this storage tank has an emergency overflow drain duct 50, should there develop a flow blockage: (a) in the primary drain duct system comprising first drain duct 30 having its inlet 31 within sump 22 at Level 2 below the top surface 16T of roof 16, and (b) second drain duct 40 having its inlet 41 at level L1 at the maximum allowable level of accumulated water above the top surface 16T of roof 16.

In the drawings and text herein reference will be made to various levels L1, L2, etc. in describing the relevant structural elements and functions, these levels defined as follows.

L1 is the maximum allowable level of water on the floating roof (the maximum level of water above the top surface of the roof) which is also the level of the inlet of the second drainage duct, L2 is the level of the top surface of the roof, L3 is the level of the emergency drainage duct medial portion at a level above the level L8 of liquid stored in said tank to prevent stored product from flowing back into segment 52, 42 and then to flow via duct segments 35, 35A and valve 36 outside the tank.

L4 is the level of the bottom of the floating roof, which is the highest level of liquid stored in said tank, L5 is the level of the inlet to the first drainage duct which is located in the sump, L6 is the level of the bottom of the sump, L7 is the level of the outlet of the first drainage duct, and L8 is the level of the stored liquid.

The first drainage duct 30 has inlet 31 at level L5 within sump 32 and below the roof top surface 16T at level L2. Duct 30 extends downward as segment 32, then transversely through check valve 33 as intermediate segment 34, then as distal segment 35 to outlet 36 at level L7. The downstream part of segment 35 is a flexible hose 35A to accommodate vertical movement of the floating roof. Should duct 30 become blocked, water will fill sump 22 and rise on roof 16 to its maximum allowable level L1, and then flow into the second drainage duct 40 via its inlet 41.

Duct 40 extends from inlet 41 downward via its intermediate segment 42 to its outlet 43 which is in fluid communication with intermediate segment 34 of said first drain duct 30. Accumulated water flow through drain duct 40 will then flow downward through distal segment 35 of duct 30 to its outlet 36.

A blockage of water flow into duct 30 may occur, for example, upstream or downstream of the location where outlet 43 of duct connects to duct 30. If the blockage is upstream of outlet 43, water in sump 22 could not be drained, and thus water would accumulate on the roof until it drained downward through duct 40 as described above, and thence out through the "unblocked" distal segment 35 of duct 30.

If however, blockage occurs downstream of said location where outlet 43 of duct 40 connects into duct 30, then there can be no drainage from flow into inlet 31 of duct 30 or from flow into inlet 41 of duct 40. In this circumstance emergency overflow duct 50 solves the problem as follows. Duct 50 includes proximal segment 51 in fluid communication with intermediate segment 42 of duct 40, then transverse segment 52, and finally distal discharge segment 53 to outlet 54 below sump 22. Segment 52 is at a level higher than the highest level L8 of liquid 17 stored in tank 10, namely, higher than the level where seal 20 engages the inner surface of wall 12 of tank 10. Seal 20 may vary from the schematic symbol shown in FIG. 2, but it is adapted to engage the outer circumferential edge of the floating roof and the inner surfaces of the walls of the tank, and to thereby define the highest level to which liquid 17 can rise, which is influenced by the elevation of the roof floating in said liquid.

In the preferred embodiment of emergency overflow duct 50 as seen in FIG. 2, the proximal segment 51 extends at an upward angle via its inlet 51A fluid connection to duct 40. If there is a flow blockage in segment 34 of duct 30, water flowing down duct 40 can turn and flow up segment 51 of duct 50 and become discharged through outlet 54 of duct 50. If there is a flow blockage in segment 35 of duct 30, water flow from segment 34 of duct 30 or from duct 40 can flow up segment 51 of emergency overflow duct and then be discharged via outlet 54.

As disclosed in FIG. 2, segment 51 of emergency overflow duct 50 and duct 40 define a generally upright Y-shaped configuration with segment 51 being an upwardly inclined arm of the Y. With this configuration water in overflow duct 40 will flow from inlet 41 down duct 42 to outlet 43 and thence via ducts 34 to outlet 36. Also by this configuration, the water flowing downward in duct 42 will not flow upward into duct 50 and outlet 54 into liquid product 17.

Initial opening of the emergency drainage system occurs when the accumulated water reaches the maximum allowable level L1. Inlet 41 of duct 40 is normally closed by cover 44 to prevent product emission which automatically opens when the accumulated water level reaches L1 because of the cover's flotation pontoons 45 and closes when the water level drops below L1.

As seen in FIG. 2, the configuration of this duct system prevents back-flow of liquid (typically oil) from its storage area up duct 53, as follows. Since fluid will seek its own level, when there is no downward flow of water in duct 40, oil 17 will tend to flow up duct segment 53, but it will not flow higher than level L8 which is the highest level it ever reaches relative to the floating roof. Since duct segment 52 is higher than level L8, such backflow will not rise into duct 52 and thus will not further flow via duct 51 into duct segments 35, 35 of duct 30 or to outlet 36 to the ground or atmosphere.

Also, if water in sump 22 evaporated and there was no water in duct 30, there would be no backflow of oil from duct 53 nor oil vapor escaping to the atmosphere because:

a) oil would not rise into duct 52 which is above level L8 as described above, b) vapor from oil in duct 53 would not escape via duct 52, 51, 42 because of cover 45, and c) vapor from oil in duct 53 would not escape via duct segments 52, 51 and 34 (of duct 30) to opening 31 because of check valve 33.

Emergency overflow duct 50 functions automatically in the event of any of the flow blockages described and provides a very economical and effective solution to a potentially dangerous situation.

Although various embodiments that incorporate the teachings of the present invention have been shown and described in detail above, those of ordinary skill in the art can readily devise other and varied embodiments, and the scope of the invention is to be determined by the claims that follow.

The invention claimed is:

1. A floating roof and emergency overflow drainage system for water accumulation on said floating roof which has a bottom surface adapted to cover and float atop a liquid in a storage tank having cylindrical side walls which have inner surfaces, said floating roof having an outer circumferential edge and an annular seal adapted to engage both said outer circumferential edge and said inner surface of said cylindrical sidewalls of said tank, said annular seal having a bottom surface, said tank adapted to contain said accumulated water up to a predetermined maximum allowable level (L1) above the roof's top surface, said system comprising:

a. a water collection sump formed as a downward extending recess in said top surface of said roof and adapted to receive water accumulated atop said roof, b. a first drainage duct having an inlet within said water collection sump at an elevation (L5) below said top surface of said roof, an outlet for draining water at an elevation (L7) below said sump, and an intermediate portion extending transversely between said inlet and said outlet, c. a second drainage duct having an inlet above said top surface of said roof, an intermediate portion extending downwardly from said inlet, and an outlet in fluid communication with said intermediate portion of said first duct in said sump, and d. an emergency overflow duct including:

(1) an inlet in fluid communication with said second duct, (2) a proximal portion extending upwardly from said inlet, (3) a medial portion extending transversely from said proximal portion at an elevation (L3) higher than said bottom surface of said sump, and (4) a distal portion extending downward from said medial portion and terminating in an outlet below said sump.

2. The floating roof and emergency overflow drainage system according to claim 1 where said emergency overflow duct inlet is in fluid communication with said intermediate portion of said second drainage duct.

3. The floating roof and emergency overflow drainage system according to claim 2 where said proximal portion of said emergency overflow duct extends from said inlet thereof at an upward inclined angle to said medial portion thereof.

4. The floating roof and emergency overflow drainage system according to claim 3 where said medial portion of said emergency overflow duct extends generally horizontally between said proximal portion and said distal portion.

5. The floating roof and emergency overflow drainage system according to claim 1 where said first drainage duct further comprises a check valve in said intermediate portion thereof allowing fluid flow only in the direction from said inlet to said outlet thereof.

6. A floating roof and emergency overflow drainage system according to claim 1 wherein said second duct and said proximal portion of said emergency overflow duct define generally an upright Y shape having at least one upwardly inclined arm, and with said proximal portion of said emergency overflow duct being said at least one upward inclined arm of said Y shape.

7. The floating roof and emergency overflow drainage system according to claim 1 wherein said inlet of said second duct further comprises a floatable cover that has a lower position where it closes said inlet of said second duct and an upper position where it opens said inlet, said cover remaining in its lower position until accumulated water atop said roof causes said cover to float upward to said open position.

8. The floating roof and emergency overflow drainage system according to claim 7 wherein said cover comprises a central part and at least one downward extending buoyant float element, said cover when in its lower position having said central part sealed against said inlet of said second duct.

9. The floating roof and emergency overflow drainage system according to claim 8 where said cover comprises two spaced apart buoyant float elements extending downward from said central part.

10. The floating roof and emergency overflow drainage system according to claim 1 wherein said overflow outlet of said emergency overflow duct discharges into said stored product below said sump.

11. The floating roof and emergency overflow drainage system according to claim 1 where said first duct outlet is external of said tank.

12. A method of providing emergency overflow drainage for water accumulation on a floating roof which has a bottom surface adapted to cover and float on a liquid in a storage tank having cylindrical side walls which have inner surfaces, said floating roof having an outer circumferential edge and an annular seal adapted to engage both said outer circumferential edge and said inner surface of said cylindrical sidewalls of said tank, said annular seal having a bottom surface, said tank adapted to contain said accumulated water up to a predetermined maximum allowable level on the roof's top surface, said method comprising:

a. providing a water collection sump formed as a downward extending recess in said top surface of said roof and adapted to receive water accumulated atop said roof, b. providing a first drainage duct having an inlet within said water collection sump at an elevation (L5) below said top surface of said roof, an outlet for draining water at an elevation (L7) below said sump, and an intermediate portion extending transversely between said inlet and said outlet, c. providing a second drainage duct having an inlet above said top surface of said roof, an intermediate portion extending downwardly from said inlet, and an outlet in fluid communication with said intermediate portion of said first duct in said sump, and d. providing an emergency overflow duct including:

(1) an inlet in fluid communication with said second duct, (2) a proximal portion extending upwardly from said inlet, (3) a medial portion extending transversely from said proximal portion at an elevation (L3) higher than said bottom surface of said sump, and (4) a distal portion extending downward from said medial portion and terminating in an outlet below said sump.

13. A storage tank with a roof adapted to float atop a liquid stored in said tank and an emergency overflow drainage system for water accumulation on said floating roof, said floating roof having an outer circumferential edge and an annular seal adapted to engage both said outer circumferential edge and said inner surface of said cylindrical sidewalls of said tank, said annular seal having a bottom surface, said tank adapted to contain said accumulated water up to a predetermined maximum allowable level above the roof's top surface, said system comprising:

a. a water collection sump formed as a downward extending recess in said top surface of said roof and adapted to receive water accumulated atop said roof, said sump having a bottom surface, b. a first drainage duct having an inlet within said water collection sump at an elevation below said top surface of said roof, an outlet for draining water at an elevation below said sump, and an intermediate portion extending transversely between said inlet and said outlet, c. a second drainage duct having an inlet above said top surface of said roof, an intermediate portion extending downwardly from said inlet, and an outlet in fluid communication with said intermediate portion of said first duct in said sump, and d. an emergency overflow duct including:

(1) an inlet in fluid communication with said second duct, (2) a proximal portion extending upwardly from said inlet, (3) a medial portion extending transversely from said inlet at an elevation higher than said bottom surface of said sump, and (4) a distal portion extending downward from said medial portion and terminating in an outlet below said sump.

14. The floating roof and emergency overflow drainage system according to claim 13 where said emergency overflow duct inlet is in fluid communication with said intermediate portion of said second drainage duct.

15. The floating roof and emergency overflow drainage system according to claim 13 where said proximal portion of said emergency overflow duct extends from said inlet thereof at an upward inclined angle to said medial portion thereof.

16. The floating roof and emergency overflow drainage system according to claim 13 where said medial portion of said emergency overflow duct extends generally horizontally between said proximal portion and said distal portion.

17. The floating roof and emergency overflow drainage system according to claim 13 where said first drainage duct further comprises a check valve in said intermediate portion thereof allowing flow only in the direction of said inlet to said outlet thereof.

18. The floating roof and emergency overflow drainage system according to claim 13 wherein said second duct and said proximal portion of said emergency overflow duct define generally an upright Y shape having at least one upwardly inclined arm, and with said proximal portion of said emergency overflow duct being said at least one upward inclined arm of said Y shape.

19. The floating roof and emergency overflow drainage system according to claim 13 wherein the said inlet of said second duct further comprises a floatable cover that has a lower position where it closes said inlet of said second duct and an upper position where it opens said inlet, said cover remaining in its lower position until accumulated water atop said roof causes said cover to float upward to said open position.

20. The floating roof and emergency overflow drainage system according to claim 19 wherein said cover comprises a central part and at least one downward extending buoyant float element, said cover when in its lower position having said central part sealed against said inlet of said second duct.

* * * * *